United States Patent [19]

Banjoya

[11] Patent Number: 4,864,267

[45] Date of Patent: Sep. 5, 1989

[54] STATIONARY INDUCTION APPARATUS WITH CORE INDENTATIONS AND RIDGES

[75] Inventor: Nagatoshi Banjoya, Ako, Japan

[73] Assignee: Mitsubishi Denki Kabushiki Kaisha, Japan

[21] Appl. No.: 140,898

[22] Filed: Dec. 31, 1987

Related U.S. Application Data

[63] Continuation-in-part of Ser. No. 97,822, Sep. 17, 1987, abandoned.

[30] Foreign Application Priority Data

Sep. 20, 1986 [JP] Japan ..... 61-223351

[51] Int. Cl.[4] ..... H01F 27/26

[52] U.S. Cl. ..... 336/210; 336/217; 336/234

[58] Field of Search ..... 336/216, 217, 218, 233, 336/234, 210; 310/217, 218

[56] References Cited

U.S. PATENT DOCUMENTS

| | | | |
|---|---|---|---|
| 2,565,303 | 8/1951 | Garbarino | 336/217 |
| 3,076,160 | 1/1963 | Daniels | 336/217 X |
| 3,252,119 | 5/1966 | Graham | 336/217 |

*Primary Examiner*—Thomas J. Kozma

*Attorney, Agent, or Firm*—Leydig, Voit & Mayer

[57] ABSTRACT

An iron core of a stationary induction apparatus such as a transformer has a plurality of steel sheets stacked in layers. Each corner of the core has a yoke member and a leg member abutting and jointed to each other at their obliquely cut ends in such a manner that the two members of alternating layers partially overlap each other over a predetermined overlapping region at each corner of the core. The surfaces of the members in the overlapping region are roughened by, for example, being provided with fine linear indentations and ridges.

2 Claims, 2 Drawing Sheets

STATIONARY INDUCTION APPARATUS WITH CORE INDENTATIONS AND RIDGES

This application is a continuation-in-part of application Ser. No. 097,822, now abandoned, filed Sept. 17, 1987.

BACKGROUND OF THE INVENTION

The present invention relates to a stationary induction apparatus of the type having a laminated core composed of a plurality of sheets stacked in layers each being constituted by a plurality of members abutting and jointed to each other at the corners of the core in such a manner that two members of alternating layers partially overlap each other over a predetermined region at each corner of the core.

FIG. 4 shows a portion of the core of an ordinary stationary induction apparatus which is typically but not exclusively a single-phase transformer, particularly a corner of the core where a plurality of members constituting the core are jointed in an abutting relation. More specifically, the core has a laminated structure composed of a multiplicity of layers each of which is constituted by a plurality of members. For instance, each layer of the core has a yoke member 1 and a leg member 2 which abut each other at a corner of the core, in such a manner that yoke member 1 and the leg member 2 of alternating layers partially overlap each other over a hatched area (referred to as overlapping area 3, hereinafter) in FIG. 4, as will be described hereinunder.

FIGS. 5 and 6 show two adjacent layers of the core at the corner portion shown in FIG. 4. The yoke member 1A and the leg member 2A of a first layer shown in FIG. 5 are rolled iron sheet members which are obliquely cut at 45° with respect to the rolling direction shown by arrows A so as to make full use of the advantage of the rolled sheet, and joined to each other at their obliquely cut ends. Similarly, the yoke member 1B and the leg member 2B of a second layer shown in FIG. 6 are rolled iron sheet members which are obliquely cut at 45° with respect to the rolling direction shown by arrows A and joined to each other at their obliquely cut ends. It will be seen, however, the positions where the yoke member 1A and the leg member 2A of the first layer are cut are altered from the positions where the yoke member 1B and the leg ember 2B are cut, as will be understood from FIGS. 5 and 6. Thus, in the first layer shown in FIG. 5, a triangular notch 4 is formed by one longitudinal side of the leg member 2A and the oblique cut edge of the yoke member 1A, whereas, in the layer shown in FIG. 6, a triangular notch 4 is formed between one longitudinal side of the yoke member 1B and the oblique cut edge of the leg member 2B.

It will be seen that, when a plurality of first layers as shown in FIG. 5 and a plurality of second layers as shown in FIG. 6 are prepared and both types of layers are stacked alternatingly, the yoke members and the leg members of the alternating layers are partially overlapped in the overlapping region 3 shown by hatching in FIG. 4. In other words, in the overlapping region 3, the yoke member and the leg member are stacked alternatingly. It will also be seen that the total thickness of the iron layer in each of the triangular notched regions 4, 4 in FIG. 4 is half that in other regions because in such a region the iron layer and vacancy appears alternatingly in the direction of thickness of the core.

Representing the width of the frame by W and the length of the shorter sides of isosceles triangle forming the notch 4 by E, the area S of the overlapping region 3 is given by the following formula (1).

$$S=E(2W-E) \tag{1}$$

In the event of an accident such as a short-circuiting in the induction apparatus, an abnormal physical force is applied to the core. This physical force is borne by the friction between the adjacent layers in the overlapping region 3.

This frictional force F is given as follows, representing the pressure at which the layers of the core are tightened by P and the friction coefficient between the adjacent layers in the overlapping region 3 by $\mu$.

$$F=\mu PS \tag{2}$$

The formula (1) above suggests that, in order to attain a high frictional force F for the purpose of sustaining a large abnormal force, it is necessary that the overlapping region area S be increased where the friction coefficient $\mu$ and the tightening pressure P are constant.

Thus, the known core structure explained above suffer from the following problem.

It is to be pointed out that the magnetic flux in the core is undesirably disturbed by the presence of the notched portions 4,4 where the total thickness of the iron is smaller than in other regions, with the result that the iron loss or hysteresis loss of the induction apparatus is increased.

It is also to be pointed out that a greater mechanical strength of the core requires a greater frictional force and, hence, a greater area S of the overlapping region 3. This, however, essentially requires that the length E in formula (1) mentioned above be increased. In consequence, the size of the notched portion 4 is increased resulting in a greater iron loss.

From the formula (2), it will be understood that the frictional force F and, hence, the mechanical strength of the core would be increased by increasing the tightening pressure P. The higher tightening pressure, however, essentially requires that the strength of the tightening structure be increased correspondingly. This is inconvenient from an economical point of view.

SUMMARY OF THE INVENTION

Accordingly, an object of the present invention is to provide an inexpensive iron core for use in stationary induction apparatus, which is improved to reduce the iron loss while increasing the frictional force between the overlapping members in each corner of the core.

To this end, according to the present invention, there is provided an iron core of a stationary induction apparatus, having a plurality of sheets stacked in layers each being constituted by a plurality of members abutting and jointed to each other at the corners of the core in such a manner that two members of alternating layers partially overlap each other over a predetermined overlapping region at each corner of the core, characterized in that the surfaces of the members in the overlapping region are roughened.

These and other objects, features and advantages of the invention will be understood from the following description of the preferred embodiment taken in conjunction with the accompanying drawings.

DESCRIPTION OF THE PREFERRED EMBODIMENT

Figure 1:
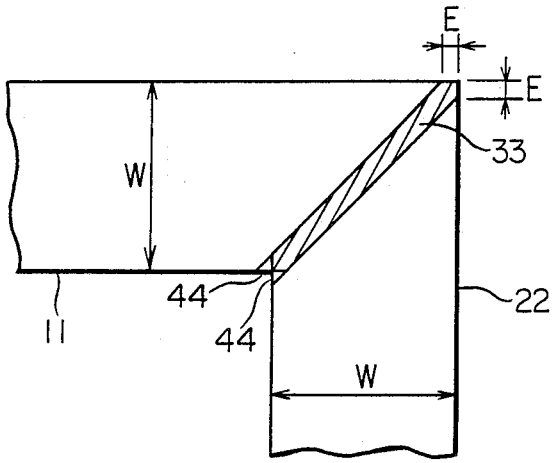
FIG. 1 is a plan view of a critical portion of a core of an embodiment of the present invention.
Figure 2:
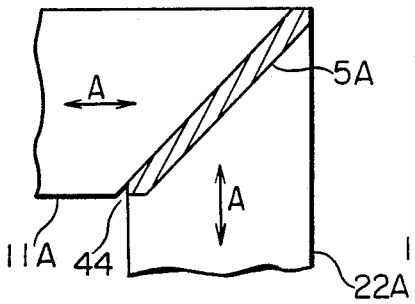
FIGS. 2 and 3 are plan views of alternating layers constituting the core shown in FIG. 1.
Figure 3:
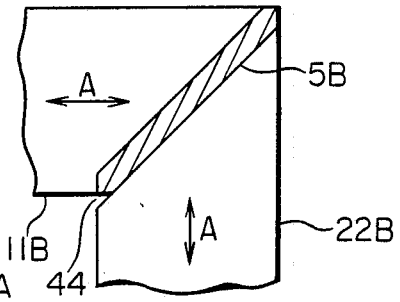

FIGS. 1 to 3 show an embodiment of a core of the invention for use in stationary induction apparatus. As in the case of the conventional core explained before, the core has a laminated structure composed of a plurality of iron sheets stacked in layers. Each layer has, at each corner of the core, a yoke member 11 and a leg member 22. The layers are stacked such that the yoke member and the leg member partially overlap each other at an overlapping region 33 shown by hatched area in FIG. 1. A numeral 44 denotes a notched region in which iron sheets and vacant spaces alternatingly appear in the direction of thickness of the core. FIGS. 2 and 3 show the alternating layers of the core. It will be seen that these two types of sheets are stacked alternatingly so as to form the laminated core shown in FIG. 1 with partial and alternating overlapping of the yoke and leg members at the overlapping region 33 as shown in FIG. 1.

Figure 4:
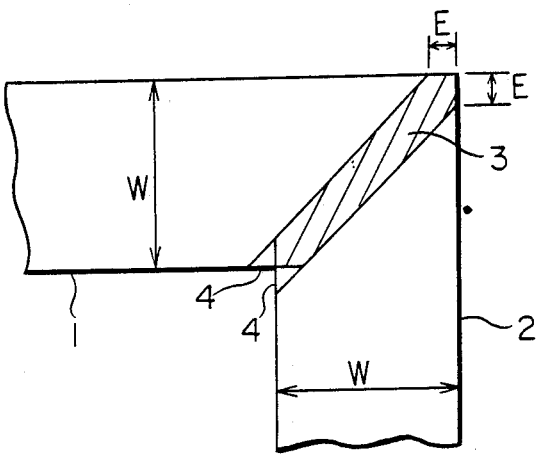
FIG. 4 PRIOR ART
FIG. 4 is a plan view of a critical portion of a conventional core.
Figure 5:
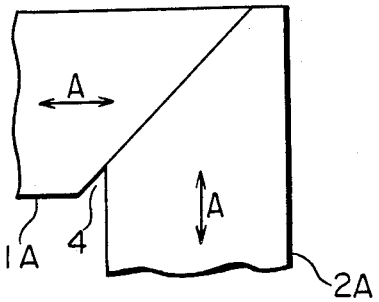
FIG. 5 PRIOR ART
FIGS. 5 and 6 are plan views of alternating layers constituting the core shown in FIG. 4.
Figure 6:
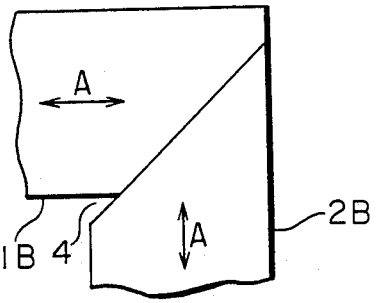
FIG. 6 PRIOR ART

More specifically, in the layer shown in FIG. 2, a yoke member 11A and a leg member 22A are made of rolled steel sheets which cut obliquely at 45° with respect to the rolling directions shown by arrows A so as to make full use of the advantage of the rolled material, and are joined to each other at their obliquely cut edges. Similarly, in the layer shown in FIG. 3, a yoke member 11B and a leg member 22B are made of rolled steel sheets cut obliquely at 45° with respect to the rolling directions shown by arrows A so as to make the full use of the advantage of the rolled material, and are joined to each other at their obliquely cut edges. This arrangement is basically the same as that of the conventional arrangement explained before. In this embodiment, however, the length E of the notched region 44 is smaller than that in the conventional arrangement shown in FIG. 4. In addition, the surfaces of the members of each layer are roughened at their portions residing in the overlapping region, as at 5A and 5B.

According to this arrangement, since the length E of the notch is reduced as compared with that in the conventional arrangement, the size of the notched region is reduced to correspondingly decrease the disturbance of the magnetic flux, thus reducing the iron loss of the core in the stationary induction apparatus.

In addition, the surfaces of the yoke members 11A, 11B and the leg members 22A, 22B in the overlapping region are roughened so that a greater frictional resistance force is developed between the adjacent layers of the core, without requiring the tightening force to be increased as compared with the conventional arrangement.

Figure 7:
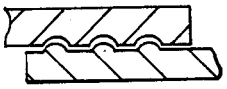
FIGS. 7 and 8 are sectional views illustrating the grooves and ridges of the roughened surface in the overlapping region.
Figure 8:
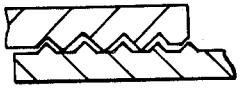

Preferably, the roughening of the overlapping surfaces are effected by forming fine linear indentations and ridges such as to exhibit a greater frictional resistance force as illustrated in FIGS. 7 and 8.

As will be understood from the foregoing description, in the core of the invention, a greater frictional force is developed by virtue of the roughened surfaces of the overlapping portions of the members in the laminated core, without requiring the area of the overlapping region and, hence, the size of the triangular notched region to be increased. In consequence, the core exhibits a greater resistance to any abnormal external force and the iron loss of the core can be reduced appreciably.

Although the invention has been described through specific terms, it is to be noted that the described embodiment is only illustrative and various changes and modifications may be imparted thereto without departing from the scope of the invention which is limited solely by the appended claims.

What is claimed is:

1. A laminated magnetic core of a stationary induction apparatus of improved mechanical and improved resistance to abnormal external physical force, the core comprising a plurality of sheets stacked in layers, each layer having a plurality of members abutting and joined to each other at corners of the core, member of adjacent layers alternately overlapping each other over predetermined regions at each corner of the core, the layers being tightened to exert a pressure on the overlapping regions, thereby producing a frictional force between the adjacent layers which bears abnormal external physical force exerted on the core;

wherein opposed surfaces of the members in the overlapping regions have linear indentations and ridges with the ridges on the surface of each member being parallel with and fitting in the indentation on the opposed surface of another member to increase the frictional force and provide an increased capacity to bear abnormal external physical force, thereby improving the mechanical strength of the core.

2. A laminated magnetic core as set forth in claim 1 wherein, in alternating layers, a triangular notch is formed by a longitudinal side of the leg member and the oblique cut edge of the yoke member and by a longitudinal side of the yoke member and the oblique cut edge of the leg member.

* * * * *